US010137596B2

(12) United States Patent
Dahy et al.

(10) Patent No.: US 10,137,596 B2
(45) Date of Patent: Nov. 27, 2018

(54) FLEXIBLE HIGH-DENSITY FIBERBOARD AND METHOD FOR MANUFACTURING THE SAME

(71) Applicant: UNIVERSITÄT STUTTGART INSTITUT FÜR TRAGKONSTRUKTIONEN UND KONSTRUKTIVES ENTWERFEN, Stuttgart (DE)

(72) Inventors: Hanaa Dahy, Stuttgart (DE); Jan Knippers, Stuttgart (DE)

(73) Assignee: UNIVERSITÄT STUTTGART INSTITUT FÜR TRAGKONSTRUKTIONEN UND KONSTRUKTIVES ENTWERFEN, Stuttgart (DE)

( * ) Notice: Subject to any disclaimer, the term of this patent is extended or adjusted under 35 U.S.C. 154(b) by 41 days.

(21) Appl. No.: 15/322,489

(22) PCT Filed: Jun. 16, 2015

(86) PCT No.: PCT/EP2015/001238
§ 371 (c)(1),
(2) Date: Dec. 28, 2016

(87) PCT Pub. No.: WO2016/005026
PCT Pub. Date: Jan. 14, 2016

(65) Prior Publication Data

US 2017/0144327 A1 May 25, 2017

(30) Foreign Application Priority Data

Jul. 8, 2014 (EP) ..... 14002343

(51) Int. Cl.

| | |
|---|---|
| ***B27N 3/04*** | (2006.01) |
| ***B27N 3/28*** | (2006.01) |
| ***B27N 7/00*** | (2006.01) |
| ***B27N 3/00*** | (2006.01) |
| *B27N 1/00* | (2006.01) |

(52) U.S. Cl.
CPC ..... *B27N 3/04* (2013.01); *B27N 3/002* (2013.01); *B27N 3/28* (2013.01); *B27N 7/005* (2013.01); *B27N 1/003* (2013.01)

(58) Field of Classification Search
CPC ..... B27N 1/003; B27N 3/002; B27N 3/04; B27N 3/28; B27N 7/005; Y10T 428/3188
USPC ..... 264/143, 171.24; 428/378, 507
See application file for complete search history.

(56) References Cited

U.S. PATENT DOCUMENTS

| | | | | |
|---|---|---|---|---|
| 4,828,913 | A | 9/1989 | Kiss | |
| 6,451,153 | B1 * | 9/2002 | Symons | B29C 70/58 156/276 |
| 6,620,507 | B2 * | 9/2003 | Kadowaki | B29B 9/14 264/143 |
| 2006/0180285 | A1 | 8/2006 | Yang et al. | |
| 2011/0139387 | A1 * | 6/2011 | Balbo Block | B29C 33/62 162/158 |
| 2012/0088874 | A1 * | 4/2012 | Bonin | B28C 5/026 524/280 |
| 2015/0197943 | A1 * | 7/2015 | Ziegler | B32B 37/10 428/161 |

FOREIGN PATENT DOCUMENTS

| | | | |
|---|---|---|---|
| CA | 2179820 | C | 10/2006 |
| CN | 101081540 | A | 5/2007 |
| EP | 0410553 | A2 | 1/1991 |
| KR | 20100031790 | A | 3/2010 |
| WO | 0162492 | A1 | 8/2001 |
| WO | 2010041566 | A1 | 4/2010 |

OTHER PUBLICATIONS

Database WPI, Week 201058, Thomson Scientific, London, GB; AN 2010-D83307, XP002743815.
Database WPI, Week 200863, Thomson Scientific, London, GB; AN 2008-K47087, XP002743816.
Patent Cooperation Treaty (PCT), International Search Report and Written Opinion for Application PCT/EP2015/001238 filed Jun. 16, 2015, dated Sep. 9, 2015, International Searching Authority, EP.

* cited by examiner

*Primary Examiner* — Thao T Tran
(74) *Attorney, Agent, or Firm* — McDonald Hopkins LLC

(57) ABSTRACT

The present invention provides a flexible high-density fiberboard which is essentially free of formaldehyde and isocyanates and comprises 70 to 90% by weight of straw fibers, and 30 to 10% by weight of a thermoplastic elastomer and one or more optional additive(s). Furthermore, the present invention provides a method for manufacturing such a flexible high-density fiberboard comprising the steps of providing straw fibers, providing a thermoplastic elastomer in powder form, optionally providing one or more additive(s), dry mixing the straw fibers, the thermoplastic elastomer powder and optionally the one or more additive(s), such that a mixture comprising 70 to 90% by weight of the straw fibers, and 30 to 10% by weight of the thermoplastic elastomer and one or more of the optional additive(s) is obtained, extruding the obtained mixture at a temperature such that the thermoplastic elastomer powder is in a molten state, and pressing the extruded mixture.

10 Claims, No Drawings

FLEXIBLE HIGH-DENSITY FIBERBOARD AND METHOD FOR MANUFACTURING THE SAME

This application is a 35 U.S.C. 371 national stage filing and claims priority to PCT Application No. PCT/EP2015/001238, entitled "FLEXIBLE HIGH-DENSITY FIBERBOARD AND METHOD FOR MANUFACTURING THE SAME," filed Jun. 16, 2015, which claims the benefit of European Application No. 14002343.3, entitled "FLEXIBLE HIGH-DENSITY FIBERBOARD AND METHOD FOR MANUFACTURING THE SAME" filed Jul. 8, 2014, both of which are incorporated by reference herein in their entirety.

The present invention relates to a flexible high-density fiberboard and a method for manufacturing the same. In particular, the present invention relates to a flexible high-density fiberboard which is essentially free of formaldehyde and isocyanates and comprises straw fibers and a thermoplastic elastomer, and a method for manufacturing the same.

Fiberboard is a type of product that is made of fibers of various origin (usually natural fibers from wood, sugarcane, hemp, straw, etc.) and a binder or even without a binder. Types of fiberboard include particle board, medium-density fiberboard (MDF) and hardboard. Fiberboard is sometimes used as a synonym for particle board, but particle board usually refers to low-density fiberboard. Fiberboard, in particular MDF, is heavily used in the furniture industry. For pieces that will be visible, a veneer of wood is often attached onto fiberboard to give it the appearance of conventional wood. Fiberboard is also used in the automobile industry to create free-form shapes such as dashboards and inner door shells.

In the following, presently manufactured and used fiberboards and their advantages and disadvantages are illustrated.

Classic Wood-based and Agro-fibre Based Composite Fiberboards

Currently used composite fiberboards refer mostly to the wood adhesive bonded products ranging from fiberboards to laminated beams (Arias, C., 2008. *Binderless Fiberboard Production from Cynara Cardunculus and Vitis Vinifera*. Tarragona-Spain: University Rovira).

For the sake of wood replacement, it was suggested after the changes in practices of forestry to apply agro-fibers as a main component in boards. In this case, agro-fibers can be bonded with thermoset resins to form different panel types, similar to classical particle and fiberboards or even oriented strandboard (OSB).

The methods of manufacturing wood-based fiberboard and accordingly agro-fiber-based fiberboards are generally divided into two main production methods.

The first method is the wet method, which is based on corresponding methods in the paper industry, where the fiber distribution occurs in water as the fibrils are distributed in a mat form, before being pressed as a board. Hence, the fiber moisture content during production exceeds 20%. In the wet process, the fiberboards are generated from the ligno-cellulosic fibers that are previously de-fibrillated through specific mechanical, thermal and/or chemical processes, where the fibrils are refined and extracted.

The second method is the dry process, which is considered more environmentally friendly, where the fiber moisture content should be less than 20% and fiber distribution takes place using an air blow with a blow-line, where fibrils are fed from a dryer to be bonded with a binder, before being formed as a web, and then pressed to become a board. The binding process takes place conventionally using a synthetic resin in small quantities with the help of hot pressing.

However, most of the available commercial resins applied in said dry process include formaldehydes as a main component in high contents, like urea-formaldehyde (UF) or phenol-formaldehyde (PF), which cause a huge environmental and health problem due to the diseases that can be caused by inhalation of these substances when they are applied in interiors, as continuously tiny amounts of resin components, known as volatile organic compounds (VOC), evaporate in the inner air at room temperature, which is considered a big threat for human health. Moreover, formaldehyde is classified as a very volatile organic compound (VVOC), as it evaporates already at 19.5° C., which makes it the most dangerous material spread nowadays in buildings, in particular through fiberboards.

Moreover, some of the available commercial resins applied in said dry process include isocyanate, which is the main component of the commercial resin methylene diphenyl diisocyanate (MDI). Although the same is a non-formaldehyde resin, it is considered to cause cancer and accordingly has been classified by the European Union as "R 40 category 3 carcinogen" since December 2010.

All these harmful problems appear not only during the useful lifetime of the boards, but even after the end of the useful lifetime of them. In particular, an appropriate incineration would be very expensive, and recycling or downcycling is not possible in this case. Thus, the destruction of classic wood-based and agro-fibre based composite fiberboards affects humans, various other organisms and finally the whole eco-system.

WPCs (Wood Plastic Composites)

This type of composites resembles the fiberboard disclosed in the present application in the sense that wood flour is present together with a thermoplastic binder, such that WPCs fall within the biocomposite board category, being processed using plastic-industry machinery. The typical commercial WPC composition is a wood flour filling load of an average of about 70% together with 25% thermoplastic polyolefin binders and 5% additives (Vogt, D. et al., 2005. *Wood Plastic Composites (WPC): Markets in North America, Japan and Europe with emphasis on Germany*, Hürth-Germany: nova-Institut GmbH).

The disadvantages of WPCs are mainly due to the main ingredient, wood, which is a non-annual resource that is not available in many plots worldwide, which is in contrast to the renewability and availability of agro-fibers. In addition, further to UV additives, high amounts of flame-retardancy additives have to be added to WPCs. Finally, although WPCs can be recycled, after several recycling cycles, no further end-of-life options, like compostability, are available.

Binderless Boards

Furthermore, binderless boards are present in the markets, like the Stramit® boards and similar products that do not need binders to form the boards, but heat and pressure to bind the fibers together. Such binderless boards still have many problems, inter alia that merely large thicknesses can be achieved by the corresponding processing techniques, and that there is a dependency on additional external materials, like paperboard, for stabilization. The main drawbacks of these types of fiberboards are their weight per $m^2$ and wide panels' thicknesses in addition to the release of fibers from the core as well as the need of extra materials in which the agro-fibers can be compacted, like paperboard or externally treated natural fiberboards.

Agro-fibers and Elastomers

Until now, providing a mixture of straw with elastomers was rarely applied. One example for such a combination is the combination of recycled waste tires for acoustic insulation, which could also be appropriate to prevent impact damages and were found to have better properties than wood insulation panels applied for the same application. The panels have different fiber contents of up to 30% by weight of rice straw. The use of waste tire composites reinforced with rice straw as construction materials is also disclosed (HS, Y. et al., 2004, Possibility of using waste tire composites reinforced with rice straw as construction materials, October 95(1)).

According to previous researches, the disclosed filling loads of agro-fibers in the elastomeric matrices are rather low due to the complicated nature of the elastic binders. This prevented the wide application possibility of such developments on a commercial scale with affordable prices.

Elastic/Flexible Fiberboards

A combination of wood, cork, latex and polyurethane (PU) is available as a flexible fiberboard Recoflex® from the company BSW Berleburger Schaumstoffwerk GmbH.

However, the combination of the non-annually renewable wood with the expensive slow-renewable cork is the main disadvantage of this product. Cork is considered an expensive renewable resource, in contrast with the suggested agro-fibers, as cork is not available except in limited quantities in some parts of the world. Furthermore, the combination of the natural components with polyurethane with its isocyanate content results in high health risks. In addition, the product has only one end-of-life option, which is recyclability.

KR 2010 0031790 discloses a high strength and lightweight plastic board composition comprises 10-70 parts by weight of main raw material, 10-70 parts by weight of filler, 1-30 parts by weight of a resin compound for reforming properties, 0-15 parts by weight of a resin for imparting elasticity, and 0-10 parts by weights of plasticizer. The main raw material is a mixture of at least one or two selected from PE, PP, and other kinds of recycled waste vinyl In view of the above, it is an object of the present invention to provide a flexible high-density fiberboard having a high flexibility, which does not contain formaldehyde and isocyanates, which includes natural fibers from cheap annual resources, and which can be recycled and preferably also composted, as well as a corresponding manufacturing method.

The above object is achieved by the flexible high-density fiberboard according to claim 1 and the method for manufacturing the same according to claim 9. Further embodiments of the present invention are set out in the dependent claims.

In particular, the present invention provides a flexible high-density fiberboard essentially free of formaldehyde and isocyanates and comprising 70 to 90% by weight of straw fibers, and 30 to 10% by weight of a thermoplastic elastomer and one or more optional additive(s), said constituents amounting to 100% by weight in total. The term "essentially free of formaldehyde and isocyanates" means "no or a low content of formaldehyde and isocyanates", where "low content of formaldehyde and isocyanates" means ≤0.05 ppm.

Preferably, the flexible high-density fiberboard comprises 80 to 90% by weight of straw fibers and 20 to 10% by weight of a thermoplastic elastomer and one or more optional additive(s).

Concerning the content of the thermoplastic elastomer and the one or more optional additive(s) of 30 to 10% by weight, it should be noted that in case one or more additive(s) is/are contained, the additive content is at the expense of the content of the thermoplastic elastomer. In particular, the optional additive content may range from 1 to 3% by weight and preferably 1.5 to 2.5% by weight, such that the content of the thermoplastic elastomer in this case may vary correspondingly to provide a sum of 30 to 10% by weight of the thermoplastic elastomer plus additive.

The present flexible high-density fiberboard is manufactured from annually generated straw fibers. The straw fibers are bonded without chemical pre-modification by a thermoplastic elastomer essentially free of formaldehyde and isocyanates using classic plastic-industry machinery. Applying natural straw fibers without modifications enables the inner natural silica contents of these fibers to be active as a partial replacement of mineral flame-retardants that are to be added in minimal quantities to reach a DIN 4102-B1 (difficult to ignite) material class.

These combined parameters minimize the health risks during the manufacturing process as well as during the usage lifetime, when the present flexible high-density fiberboard is applied indoors. The present flexible high-density fiberboard has at least one advantageous end-of-life option as it can be recycled in a number of recycling cycles and then preferably industrially aerobic composted, which is a highly positive environmental solution that helps in minimizing waste accumulation. Waste accumulation minimization is accordingly hereby achieved twice: once during the production phase, as the present flexible high-density fiberboard is mainly based on straw as a kind of agricultural residue fibers, and secondly after the end of its useful lifetime. These ecologic end-of-life options are rarely available in the contemporary fiberboard market worldwide.

Accordingly, the present invention provides a number of positive environmental aspects including recyclability, no health-risks and waste accumulation minimization.

In addition to these ecologic values, the flexible nature of the present flexible high-density fiberboard enables attractive free-form architectural applications using available production techniques.

The present flexible high-density fiberboard can be provided with a very small thickness starting from 1 mm, and is in principal not limited with regard to the upper limit of the thickness. However, a preferred maximum thickness of the flexible high-density fiberboard is 100 mm, preferably 70 mm and in particular 50 mm, 40 mm or 30 mm. Preferred thickness ranges of the flexible high-density fiberboard are from 1 to 100 mm, 5 to 50 mm, 10 to 40 mm and 15 to 30 mm, and any combination of these ranges. Furthermore, due to its flexibility, the flexible high-density fiberboard can usually be transported in the form of rolls to minimize transportation and storage costs, hence assuring the highest economic profit.

On the other hand, the above-described known fiberboards present in the contemporary markets usually lack health-safety and cause more or less severe environmental problems, as the applied binders are mostly composed of carcinogenic components in high amounts and are of non-recyclable nature. Furthermore, the above-described known fiberboards are only applicable in 2D planar architectural functions.

The straw used in the present flexible high-density fiberboard is obtainable from the agricultural residues stream and is the cheapest (40 to 60 EUR/ton) available natural fiber abundantly available worldwide from cereal crops agricultural streams. Asian countries, especially China, then northern America, especially USA, followed by Europe, especially Germany, then South America and finally North Africa and the Middle East are the main straw producers worldwide, according to FAO (Food and Agriculture Organization of the United Nations) and World Bank in 2011.

According to a preferred embodiment of the present invention, the straw fibers are selected from the group consisting of wheat straw fibers, corn straw fibers, rice straw fibers, oat straw fibers, barley straw fibers and rye straw fibers. Of these different types of straw fibers, wheat and rice straw fibers are particularly preferred. Rice straw fibers are even more preferred due to their natural high silica content that can be as high as 20% by weight of silica, which is a natural fire retardant.

According to a preferred embodiment of the present invention, the straw fibers of the flexible high-density fiberboard have a length of ≤5.0 mm, preferably ≤3.0 mm, more preferably ≤2.5 mm. The actual fiber lengths greatly depend on the given amount of the straw fibers within the flexible high-density fibreboard. In the present invention, 70-90% of pure "un-hybrid" natural fibers (a basic renewable resource—an agricultural residue—that is not chemically modified/processed) are reachable, with such defined fiber-length ratio.

According to a preferred embodiment of the present invention, the one or more optional additive(s) is/are selected from the group consisting of fire retardants, coupling agents, preferably silane coupling agent and maleic anhydride, water-repelling agents, preferably calcium chloride, and color pigments. As color pigments, fine particle pigments are recommended to be mixed in a dry-process before compounding, preferably matte pigments applied in thermoplastic-based and flexible-PVC products, without being wetted or transformed into liquid forms. As fire retardants, ecologically friendly halogen-free flame-retardant additives should be added, preferably phosphorous-based/mineral-based flame-retardant additives can be used.

As mentioned above, according to a preferred embodiment of the present invention, the straw fibers are rice straw fibers. In this embodiment, the flexible high-density fiberboard can also be free of additional fire retardants. As mentioned, rice straw fibers are particularly preferred due to their natural high silica content that can reach until 20% of the whole dry fiber weight (cf. US 2006/0180285 A1 or Buzarovska, A. et al., Potential use of rice straw as filler in eco-composite materials, *Journal of Crop Science,* 2008, pp. 37-42, respectively) that can work as a natural flame retardant-partial substitute. DIN 4102-B1 (difficult to ignite) material class can accordingly be reachable through adding minimal mineral-based fire-resistant additives, preferably phosphorous-based ones. Wheat straw could also be applied for the same reason and application, having also a high silica content of 4%-10% in comparison to wood fibres that have less than 1% silica (cf. Pekarovic, J., Pekarovicova, A. & III, F., 2008. Preparation of Biosilica-enriched Filler and an Example of its Use in Papermaking Retention System, *Papir a Celuloza,* 7-8(63), pp. 218-222).

According to the present invention, a thermoplastic elastomer (cf. DIN EN ISO 18064) is used as a binder. Dry emulsion binders of high melt viscosity that can be processed as thermoplastics, can also be applied as binders instead. The high melt viscosity enables the optimum and homogenous flow/rheology of the resin between the natural fibers. In this case, the dry emulsion binders are preferred to be present in a grind-form, rather than pellet-form, to enable quickly mixing the fiber-matrix and additives at room temperature prior to manufacturing, hence decreasing the final product costs.

The thermoplastic elastomer should be in powder form and should preferably have a MFR melt index >5, preferably >6 ([$cm^3$/10 min] measured at 150° C./21.6 kg/2 mm). Generally, the densities of the thermoplastic elastomer (23° C., DIN EN ISO 1183) are in the range of 1000-1200 $kg/m^3$. Typical bulk densities (DIN EN ISO 60) are in the range of 350 to 550 $kg/m^3$. The glass transition temperature of the thermoplastic elastomer used in the present invention should be ≤−10° C., measured by DSC, heating rate 10 K/min, DIN 51007.

Thermoplastic elastomers usable in the present invention can be olefin-based thermoplastic elastomers, urethane-based thermoplastic elastomers, thermoplastic polyester elastomers or vinyl acetate-based thermoplastic elastomers.

According to a preferred embodiment of the present invention, the thermoplastic elastomer is selected from a vinyl acetate based co- or terpolymer. More preferably, the thermoplastic elastomer is selected from a vinylacetate-ethylene-vinylester copolymer. The vinylester unit can for example be vinyl versatate. The use of such copolymers as the thermoplastic elastomer in the flexible high-density fiberboard provides the same with a particular advantageous compostability.

According to an even more preferred embodiment of the present invention, the thermoplastic elastomer is a vinylacetate-ethylene-vinylester copolymer, which is available, for example, as VINNEX® 2505 from Wacker Chemie AG, Munich, Germany.

According to a preferred embodiment of the present invention, the flexible high-density fiberboard further comprises a veneer on one or both surfaces thereof.

As mentioned above, the flexible nature of the flexible high-density fiberboard enables attractive free-form architectural applications using available production techniques. In order to fix such free-form architectural applications in their formed or bent state, it is merely necessary to provide the flexible high-density fiberboard with said veneer on one or both surfaces thereof. Thus, by the flexible high-density fiberboard, free-form fittings and furniture, which are highly desired by customers for interior designs, can be provided at a low price compared to conventional materials for free-form designs.

Summarizing, the flexible high-density fiberboard according to the present invention can be used in a plurality of applications, like for example furniture, in particular free-form furniture, partition walls, flooring having anti-slip and anti-shock function (for example, in gymnasiums), and flooring replacing cork flooring in living spaces, and also in flooring system combinations, wherein, for example, flooring tiles have an underlayer of the present flexible high-density fiberboard.

Furthermore, the method for manufacturing a flexible high-density fiberboard comprises the steps of providing straw fibers, providing a thermoplastic elastomer in powder form, optionally providing one or more additive(s), dry mixing the straw fibers, the thermoplastic elastomer powder and optionally the one or more additive(s), such that a mixture comprising 70 to 90% by weight of the straw fibers and 30 to 10% by weight of the thermoplastic elastomer, preferably 80 to 90% by weight of the straw fibers and 20 to 10% by weight of the thermoplastic elastomer, and one or more of the optional additive(s) is obtained, extruding the obtained mixture at a temperature such that the thermoplastic elastomer powder is in a molten state, and pressing the extruded mixture.

The present method is carried out according to well-known plastics and fiberboard technology and machines, like for example, mixing, extruding and pressing equipment well known to the skilled person. In this context, the extruding and pressing temperatures are set according to the specific thermoplastic elastomer used and may be in a range of, for example, 170 to 230° C.

According to a preferred embodiment of the present method, the originally used straw fibers preferably have a length of ≤7.0 mm, more preferably ≤5.0 mm and in particular ≤4.0 mm. In this context, it should be noted that the straw fibers in the final product have a length less than the straw fibers in the mixture fed into the extruder, since the straw fibers are further cut and shortened within the extruder. The straw fiber can be combined with its released fines, resulted from the chopping procedures, before the compounding process.

Concerning further preferred features of the present method, it is referred to the corresponding preferred features of the flexible high-density fiberboard as described above.

EXAMPLE

In the following, a preferred example of a flexible high-density fiberboard according to the present invention manufactured by the method of the present invention is described. However, it should be noted that the scope of the present invention is by no means restricted by said example.

Starting Materials

Straw: rice straw

Thermoplastic elastomer: VINNEX® 2505 Vinylacetate-ethylene-vinylester copolymer powder (available from Wacker Chemie AG, Munich, Germany)

Straw Analysis and Preparation before Compounding

Chemical Analysis

Straws 1 and 2 were chopped and burnt at 550° C. to prepare straw ash samples. The inorganic chemical components of the two straw ash samples were analyzed and the results shown in table 1 were obtained.

TABLE 1

Chemical composition of the inorganic ash components of straws 1 and 2

| mg/kg Ash | Al | Ca | Fe | K | Mg | Mn | Na | P | S | Si | Zn |
|---|---|---|---|---|---|---|---|---|---|---|---|
| Straw 1 | 3.566 | 16.630 | 3.599 | 80.573 | 11.657 | 1.561 | 33.071 | 2.326 | 4.666 | 313.113 | 129 |
| Straw 2 | 2.065 | 18.801 | 1.553 | 80.218 | 6.893 | 2.937 | 1.917 | 6.451 | 4.628 | 343.817 | 70 |

Humidity Assessment

The humidity of straws 1 and 2 was measured according to American Society of Agricultural and Biological Engineers Standards (ASAE S358.2, 2006).

The chopped straw samples were weighed before and after their dehydration for 24 hours within a vacuum oven at 105° C. The humidity of the samples ranged from 6-7%, which indicates that the fibres were in an acceptable state to be mixed with the thermoplastic elastomer without further drying procedures. The moisture content of natural fibers before being mixed with the polymer should range between 3-8%. Accordingly, the straw fibres of straws 1 and 2 were directly applied in their natural dry state having a humidity of 6-7% without further dehydration.

Straw Fibre Chopping and Grinding

A chopping machine provided from FRITSCH GmbH, Idar-Oberstein, Germany, was applied in the chopping procedure of the straw fibres before compounding. This machine has a combined system of a shredder and an absorbing apparatus, linked to a collector, which is an environmentally-friendly chopping process without released dust or fumes. The fibre length of the obtained straw fibers is 0.5 to 5 mm, which is, however, further shortened during the compounding process by means of the revolving extruder screws.

Compounding Process and Parameters

The straw fibres were not chemically modified prior to compounding. The straw fibres and the VINNEX® 2505 powder were mixed at room temperature in a ratio of 80:20 in terms of weight, where the straw amounts to 80% of the total weight of the mixture and the VINNEX® 2505 powder amounts to 20% of the total weight of the mixture. The mixture was then fed gradually to a batch mixing machine, HAAKE Rheocord 90, Thermo Fisher Scientific LLC, Asheville, N.C., U.S.A., simulating a lab-scale twin screw extruder at 50 rpm and 180° C.

Specimen Preparation a. The discharge (straw-binder mixture) was taken from the batch mixing machine and applied on a copper plate with Teflon® foil and a high temperature releasing agent, and then pressed with a laboratory bench-top press-machine (Type P 200 E) from Dr. Collin GmbH—Ebersberg, Germany at 180° C. and 200 bar for 3-5 minutes.
b. The resulting plates had a thickness of 2 mm and were cut using a small saw machine to produce the test specimen.

The physical characteristics of the obtained test specimen are the same:

Density: 1099.9 kg/m$^3$ (according to DIN 53479 or DIN EN ISO 1183-1)

Tensile strength: 2.60 N/mm$^2$

Tensile modulus: 28.91 N/mm$^2$ (both the tensile strength and the tensile modulus were tested with the following conditions: Pre-load: 0.01 N/mm$^2$, Pre-load speed: 10 mm/min, test speed: 50 mm/min, machine heads displacement: 250 mm)

Thickness swelling (TS) as an indication of water absorption was measured according to the same conditions of DIN EN 317, 1993, but using smaller square-shaped probes of 10×10 mm$^2$ and an original thickness of 2 mm. TS was recorded in this case to be 21.3%. According to the regulated accepted properties of dry-processed MDF (EN 622-5, 2010-03), TS is accepted till 45% for the plates of thicknesses from 1.8-2.5 mm in case of dry interior applications. Accordingly, this indicates that the straw-based fiberboard lies in the acceptable range of thickness swelling. These values were recorded without lamination, surface treatment or additives. Hence, it is expected to have much lower TS when modified accordingly.

Fire resistance: by means of phosphorous based/mineral-based additives, DIN 4102-B1 class can be achieved. The high-silica straw showed high improvement in the flame-resistance attitude of the biocomposite that can be further optimized by means of the above suggested flame-resistant additives.

Indentation resistance: 0.02 mm after 24 hours from load removal and 3 N residual load appliance according to DIN EN 1516 (the acceptable value is up to 0.5 mm (for being suitable for flooring applications in gymnasiums) after applied standard conditions).

Biodegradability: to investigate the biodegradability, a special soil-burial field-test was applied with samples of 2 mm thickness. The test was settled for a period of 15 months, where biodegradability/micro-organismal interference was controlled each 3 months, for a total period of 15 months, by means of visual inspection—documented by photos- and weight-loss control, summing them up in the form of a table and a graph. This test simulated aerobic compost conditions to examine the possible aerobic biodegradability in the presence of oxygen in the soil's upper surface, ≤3 inches (8 cm) deep; to allow the possibility of living micro-organisms existing normally in the upper surface of normal soils to attack and digest parts of the samples. The outcome was that biodegradability was detected since the probe having 80% or more fiber load lost 41% of its weight after 15 months, despite of having a thickness of 2 mm, and was visually observed of having apparent damages.

Summarizing the above results, the flexible high-density fiberboard according to the present invention has excellent physical properties which makes the same suitable for many applications, like for example, furniture, in particular free-form furniture, partition walls, flooring having anti-slip and anti-shock function (for example, in gymnasiums), and flooring replacing cork flooring in living spaces, and also in flooring system combinations, wherein, for example, flooring tiles have an underlayer of the present flexible high-density fiberboard, without any negative impact on humans and the environment.

The invention claimed is:

1. A flexible high-density fiberboard essentially free of formaldehyde and isocyanates and comprising 80 to 90% by weight of straw fibers, and 20 to 10% by weight of a thermoplastic elastomer, wherein the thermoplastic elastomer is a vinyl acetate-ethylene-vinyl ester copolymer, and one or more optional additive(s).

2. The flexible high-density fiberboard according to claim 1, wherein the straw fibers are selected from the group consisting of wheat straw fibers, corn straw fibers, rice straw fibers, oat straw fibers, barley straw fibers and rye straw fibers.

3. The flexible high-density fiberboard to claim 1, wherein the straw fibers have a length of ≤5.0 mm.

4. The flexible high-density fiberboard according to claim 1, wherein the one or more optional additive(s) is/are selected from the group consisting of color pigments, coupling agents, water-repelling agents, and fire retardants.

5. The flexible high-density fiberboard according to claim 4, wherein the one or more optional additive(s) is/are selected from the group consisting of matte pigments applied in thermoplastic-based and flexible-PVC products, without being wetted or transformed into liquid forms, silane coupling agent and maleic anhydride, calcium chloride, and phosphorous-based/mineral-based flame-retardant additives.

6. The flexible high-density fiberboard according to claim 1, wherein the straw fibers are rice straw fibers and wheat straw fibers.

7. The flexible high-density fiberboard according to claim 1, further comprising a veneer on one or both surfaces thereof.

8. A method for manufacturing a flexible high-density fiberboard according to claim 1, comprising the steps of providing straw fibers, providing a thermoplastic elastomer in powder form, wherein the thermoplastic elastomer is a vinyl acetate-ethylene-vinyl ester copolymer, optionally providing one or more additive(s), dry mixing the straw fibers, the thermoplastic elastomer powder and optionally the one or more additive(s), such that a mixture comprising 80 to 90% by weight of the straw fibers, and 20 to 10% by weight of the thermoplastic elastomer and one or more of the optional additive(s) is obtained, extruding the obtained mixture at a temperature such that the thermoplastic elastomer powder is in a molten state, and pressing the extruded mixture.

9. The method according to claim 8, wherein the straw fibers are selected from the group consisting of wheat straw fibers, corn straw fibers and rice straw fibers, preferably wherein the straw fibers have a length of ≤7.0 mm.

10. The method according to claim 8 further comprising the step of applying a veneer on one or both surfaces of the flexible high-density fiberboard.

* * * * *